US010907278B2

(12) United States Patent
Bahlmann et al.

(10) Patent No.: US 10,907,278 B2
(45) Date of Patent: Feb. 2, 2021

(54) METHOD FOR AUTOMATICALLY PIECING A THREAD AT A WORKSTATION OF A TEXTILE MACHINE, AND TEXTILE MACHINE

(71) Applicant: Maschinenfabrik Rieter AG, Winterthur (CH)

(72) Inventors: Bernd Bahlmann, Schrobenhausen (DE); Romeo Pohn, Geisenfeld/Rottenegg (DE); Sebastian Brandl, Boehmfeld (DE); Mario Maleck, Walting (DE); Frank Baier, Hohenwart (DE); Robert Hagl, Rottenegg (DE); Thomas Gruber, Ingolstadt (DE); Robin Wein, Manching (DE); Christian Kettner, Koesching (DE); Andreas Hoyer, Mainburg (DE)

(73) Assignee: Maschinenfabrik Rieter AG, Winterthur (CH)

( * ) Notice: Subject to any disclaimer, the term of this patent is extended or adjusted under 35 U.S.C. 154(b) by 31 days.

(21) Appl. No.: 16/244,466

(22) Filed: Jan. 10, 2019

(65) Prior Publication Data

US 2019/0218688 A1 Jul. 18, 2019

(30) Foreign Application Priority Data

Jan. 16, 2018 (DE) ..... 10 2018 100 858

(51) Int. Cl.
*D01H 13/16* (2006.01)
*B65H 67/08* (2006.01)
(Continued)

(52) U.S. Cl.
CPC ..... *D01H 13/1691* (2013.01); *B65H 67/085* (2013.01); *D01H 4/50* (2013.01);
(Continued)

(58) Field of Classification Search
CPC .... D01H 13/1691; D01H 13/104; D01H 4/50; B65H 67/085; B65H 67/086; B65H 2701/31; D05B 57/26
(Continued)

(56) References Cited

U.S. PATENT DOCUMENTS 4,175,370 A * 11/1979 Stahlecker ..... B65H 59/105 57/263
4,716,718 A 1/1988 Göbbels et al.
(Continued)

FOREIGN PATENT DOCUMENTS

DE 35 15 765 A1 11/1986
DE 101 39 074 A1 2/2003
(Continued)

OTHER PUBLICATIONS

Cambridge Dictionary, "Coordinating", https://dictionary.cambridge.org/us/dictionary/english/coordinating, last visited Apr. 6, 2020.*
(Continued)

*Primary Examiner* — Shaun R Hurley
*Assistant Examiner* — Patrick J. Lynch
(74) *Attorney, Agent, or Firm* — Dority & Manning, P.A.

(57) ABSTRACT

A method for automatically piecing a thread at a workstation of a textile machine, includes seeking an end of the thread on a surface of a bobbin with a suction nozzle and unwinding the thread from the bobbin counter to a regular draw-off direction of the thread and sucking the thread into the suction nozzle. The bobbin is driven in a direction of reverse rotation with a drive. A thread loop is draw-opened in the thread and moved towards a piecing unit via movement of a feeder unit. The bobbin is driven in the direction of reverse rotation during the drawing-open of the thread loop such that
(Continued)

the thread is unwound from the bobbin. A speed of reverse rotation of the bobbin is coordinated with movement of the feeder unit.

10 Claims, 4 Drawing Sheets

(51) Int. Cl.
*D01H 4/50* (2006.01)
*D01H 13/10* (2006.01)
*D05B 57/26* (2006.01)

(52) U.S. Cl.
CPC ..... *D01H 13/104* (2013.01); *D05B 57/26* (2013.01); *B65H 2701/31* (2013.01)

(58) Field of Classification Search
USPC ..... 57/58.86
See application file for complete search history.

(56) References Cited

U.S. PATENT DOCUMENTS 5,079,908 A * 1/1992 Stahlecker ..... B65H 51/205 57/22
5,193,332 A * 3/1993 Kriegler ..... D01H 4/40 57/263
5,353,582 A * 10/1994 Citterio ..... D01H 4/50 57/263
5,509,261 A * 4/1996 Wassenhoven ..... D01H 4/32 57/100
6,804,945 B2 10/2004 Straaten
10,202,254 B2 2/2019 Maleck et al.
2006/0225398 A1* 10/2006 Badiali ..... B65H 51/205 57/22
2017/0029235 A1* 2/2017 Maleck ..... D01H 4/50
2017/0321351 A1* 11/2017 Stephan ..... D01H 4/08

FOREIGN PATENT DOCUMENTS

DE 10 2015 112 660 A1 2/2017
DE 10 2016 114 267 A1 2/2018
DE 10 2017 107 424 A1 10/2018
EP 3 135 618 A2 3/1917
EP 3 241 794 A1 11/1917
EP 2990368 A1 * 3/2016 ..... B65H 67/085
WO WO 2018/185221 A1 10/1918

OTHER PUBLICATIONS

English language translation of EP 2990368 to Mund, obtained via espacenet.com, last visited Apr. 6, 2020.*
German Patent Office Search Report, dated Nov. 28, 2018.
EP Search Report, dated May 29, 2019.

* cited by examiner

METHOD FOR AUTOMATICALLY PIECING A THREAD AT A WORKSTATION OF A TEXTILE MACHINE, AND TEXTILE MACHINE

FIELD OF THE INVENTION

The present invention relates to a method for automatically piecing a thread at a workstation of a textile machine, in which one end of the thread is sought on a surface of a bobbin with the aid of a suction nozzle and the thread is unwound from the bobbin counter to its regular draw-off direction and is sucked into the suction nozzle. The bobbin is driven in the direction of reverse rotation in this case with the aid of a drive. By way of a feed movement of a feeder unit, a thread loop of the thread is drawn open and is moved toward a piecing unit. Moreover, the invention relates to a textile machine including at least one workstation, having a suction nozzle for seeking an end of a thread on a surface of a bobbin and for sucking in the thread, and comprising a drive for driving the bobbin and unwinding the thread from the bobbin counter to its regular draw-off direction. The textile machine also includes a piecing unit for automatically piecing the thread, as well as a feeder unit for drawing open a thread loop of the thread and moving the thread loop toward the piecing unit. Moreover, the textile machine includes a controller.

BACKGROUND

In the case of textile machines such as spinning machines or winders, in which a thread is continuously produced or delivered from a delivery bobbin and wound onto a winding bobbin, the thread must be pieced once again after interruptions of the production process. These types of interruptions can take place, for example, due to a thread break, a cleaning cut, or a shutdown of the individual workstation or the entire textile machine. Various methods and various textile machines including piecing devices for automatically piecing such a thread have become known from the related art. In order to piece the thread, it is necessary to seek the thread on a surface of the bobbin with the aid of a suction nozzle. Vacuum is applied to the suction nozzle for this purpose. In order to facilitate the locating and sucking-in of the thread end, the bobbin is driven in the direction of reverse rotation in this case. As soon as the thread has been located and an appropriate thread length has been sucked into the suction nozzle, the drive for the reverse rotation of the bobbin is switched off. Simultaneously, the suction nozzle is moved slightly away from the bobbin surface, and so the sucked-in thread is now stretched between the suction nozzle and the bobbin. Thereafter, a feeder unit is moved toward the sucked-in thread, captures the thread, and forms a thread loop from the thread by being pivoted from the thread receiving position in the area of the bobbin into a thread delivery position in the area of the piecing unit. Such a textile machine and such a method are described, for example, in DE 35 15 765 C2. In the case of such devices and such a method, it has proven difficult to maintain a constant thread tension while drawing the thread loop open. This is desirable, however, in order to prevent further breaks of the thread and to prevent twists from forming in the sucked-in thread piece.

SUMMARY

A problem addressed by the present invention is therefore that of providing a method for automatically piecing a thread, with the aid of which the thread tension can be held largely constant while the thread loop is formed. Moreover, an appropriate textile machine is to be provided. Additional objects and advantages of the invention will be set forth in part in the following description, or may be obvious from the description, or may be learned through practice of the invention.

The problems are solved with the aid of the features of the invention set forth herein.

In a method for automatically piecing a thread at a workstation of a textile machine, in particular, for piecing a thread at a spinning position of a spinning machine, one end of the thread is sought on a surface of a bobbin with the aid of a suction nozzle and the thread is unwound from the bobbin counter to its regular draw-off direction and is sucked into the suction nozzle. The bobbin is driven in the direction of reverse rotation, in this case with the aid of a drive. By way of a feed movement of a feeder unit, a thread loop of the thread is drawn open and is moved toward a piecing unit, in particular a workstation-specific piecing unit.

It is now provided that the bobbin is also driven in the direction of reverse rotation during the drawing-open of the thread loop and the thread is unwound from the bobbin. A reverse rotation speed of the bobbin is coordinated with the feed movement of the feeder unit in this case. Due to the fact that the bobbin is also driven in the direction of reverse rotation during the drawing-open of the thread loop, the thread length required for the formation of the thread loop is now no longer withdrawn from the suction nozzle, as in the related art. Instead, precisely the required thread length is returned directly from the bobbin. Since the speed of the bobbin is coordinated with the feed movement of the feeder unit, it is possible to also hold the thread tension of the sucked-in thread largely constant. As a result, the formation of twists in the sucked-in thread piece, as well as further thread breaks, can be avoided. In addition, the thread length required for the piecing can be retained more exactly given a constant thread tensile force. In addition, it is also no longer necessary to initially unwind a greater amount of thread from the bobbin and suck it into the suction nozzle, which is also correspondingly time-consuming. Rather, immediately after the thread end has been captured by the suction nozzle, the thread can be received by the feeder unit and the thread loop can be drawn open.

The drive of the bobbin is preferably initially brought to a standstill after the thread end has been sucked-in and is first started moving again together with the feeder unit. As a result, the coordination with the movement of the feeder unit is possible in a particularly simple manner.

A textile machine that is suitable for carrying out the method having at least one workstation includes a suction nozzle for seeking an end of a thread on a surface of a bobbin and for sucking in the thread, a drive for driving the bobbin and unwinding the thread from the bobbin counter to its regular draw-off direction, and a piecing unit for automatically piecing the thread. Moreover, the textile machine comprises a feeder unit for drawing open a thread loop of the thread and for moving the thread loop toward the piecing unit, as well as a controller. The controller is designed for operating the drive of the bobbin according to the above-described method.

The textile machine can be designed as a spinning machine or as a winder in this case. Within the scope of the present invention, the piecing of a thread is therefore understood to be piecing on a spinning machine as well as splicing on a winder.

With respect to the method, it is also advantageous when the reverse rotation speed of the bobbin is coordinated in such a way that a thread length returned from the bobbin is always synchronous to a thread length required for forming the thread loop. In other words, the present speed of the return of the thread from the bobbin is always equal to the present withdrawal speed of the thread by the thread catcher during the drawing-open of the thread loop. As a result, it is also possible to take a demand for an additional thread length into consideration, which differs with respect to time during the feed movement of the feeder unit. Such a present demand, which differs with respect to time, to draw the thread loop further open is necessary, for example, due to the pivoting motion of a pivotable feeder unit and due to the acceleration or deceleration of the feeder unit.

With respect to a textile machine, it is also advantageous when at least the drive for the reverse rotation of the bobbin and the feeder unit are situated at the at least one workstation. It is particularly advantageous when the workstation is designed as a so-called autonomous workstation and includes, in addition to the drive and the feeder unit, a workstation-specific suction nozzle and a workstation-specific piecing unit. As a result, the coordination of the reverse rotation speed of the bobbin with the movement of the feeder unit is possible in a particularly simple way.

It is also advantageous when the feed movement of the feeder unit is a pivoting motion. As a result, the feeder unit be designed to be structurally simple and can be situated at the workstation in a space-saving way.

According to a first embodiment of the method, it is advantageous when the reverse rotation speed of the bobbin is coordinated in such a way that, at any point in time during the reverse rotation of the bobbin, a thread length presently being returned from the bobbin is always less than a thread length presently required for forming the thread loop. In other words, the speed of the return of the thread from the bobbin is always less than the withdrawal speed of the thread by the thread catcher during the drawing-open of the thread loop. As a result, a tensile force is applied to the thread, which is greater than the thread adhesiveness on the bobbin. In this way, it is ensured that the thread does not get caught on the bobbin surface due to its hairiness and, instead, can be cleanly unwound.

In this case, it can be advantageous to design the level of the thread tensile force during the return or the ratio of the reverse rotation speed of the bobbin to the withdrawal speed of the thread by the thread catcher to differ depending on the yarn which is presently spun. As a result, the different properties of the various yarns can be taken into account.

Moreover, it is advantageous when the thread tensile force is measured during the reverse rotation of the bobbin. Thus, it can be ensured, for example, that a maximum tensile force is not exceeded, by aborting the piecing operation, or the reverse rotation speed of the bobbin and/or the withdrawal speed of the thread can be adjusted in such a way that a maximum thread tensile force is not exceeded and/or a minimum thread tensile force is also not fallen below.

According to another embodiment of the method, on the other hand, the reverse rotation speed of the bobbin is coordinated in such a way that, at any point in time during the reverse rotation of the bobbin, a thread length presently being returned from the bobbin is always greater than a thread length presently required for forming the thread loop. As a result, it can be ensured that the thread length required for forming the thread loop is only returned from the bobbin and is not withdrawn, partially or entirely, from the suction nozzle once again.

In order to coordinate the reverse rotation speed of the bobbin with the feed movement of the feeder unit, it is also advantageous when a speed profile for the reverse-rotation drive is predefined and the reverse-rotation drive is driven during the feed movement of the feed unit according to the predefined speed profile. The demand for thread length to be returned, which differs at each point in time during the drawing-open of the thread loop, can be taken into account in the speed profile for the reverse-rotation drive and the thread tensile force in the sucked-in thread end can be held largely constant.

Additionally or alternatively, it is also possible, however, to measure a thread tensile force of the thread during the feed movement of the feed unit. The reverse-rotation drive is driven, in this case, according to the measured thread tensile force. The reverse rotation speed of the bobbin can always be regulated in such a way, in this case, for example, that a certain, predefinable thread tensile force is not exceeded and/or a certain, predefinable thread tensile force is not fallen below. The retention of a constant thread tensile force can be improved even further, also in connection with a speed profile for the reverse-rotation drive, by way of an additional measurement of the thread tensile force of the sucked-in thread.

The workstation comprises an appropriate measuring unit for measuring the thread tensile force of the sucked-in thread. The measuring unit can be situated, for example, in the area of the bobbin itself or even at or in the suction nozzle.

BRIEF DESCRIPTION OF THE DRAWINGS

Further advantages of the invention are described with reference to the exemplary embodiments represented in the following. Wherein.

DETAILED DESCRIPTION

Figure 1:
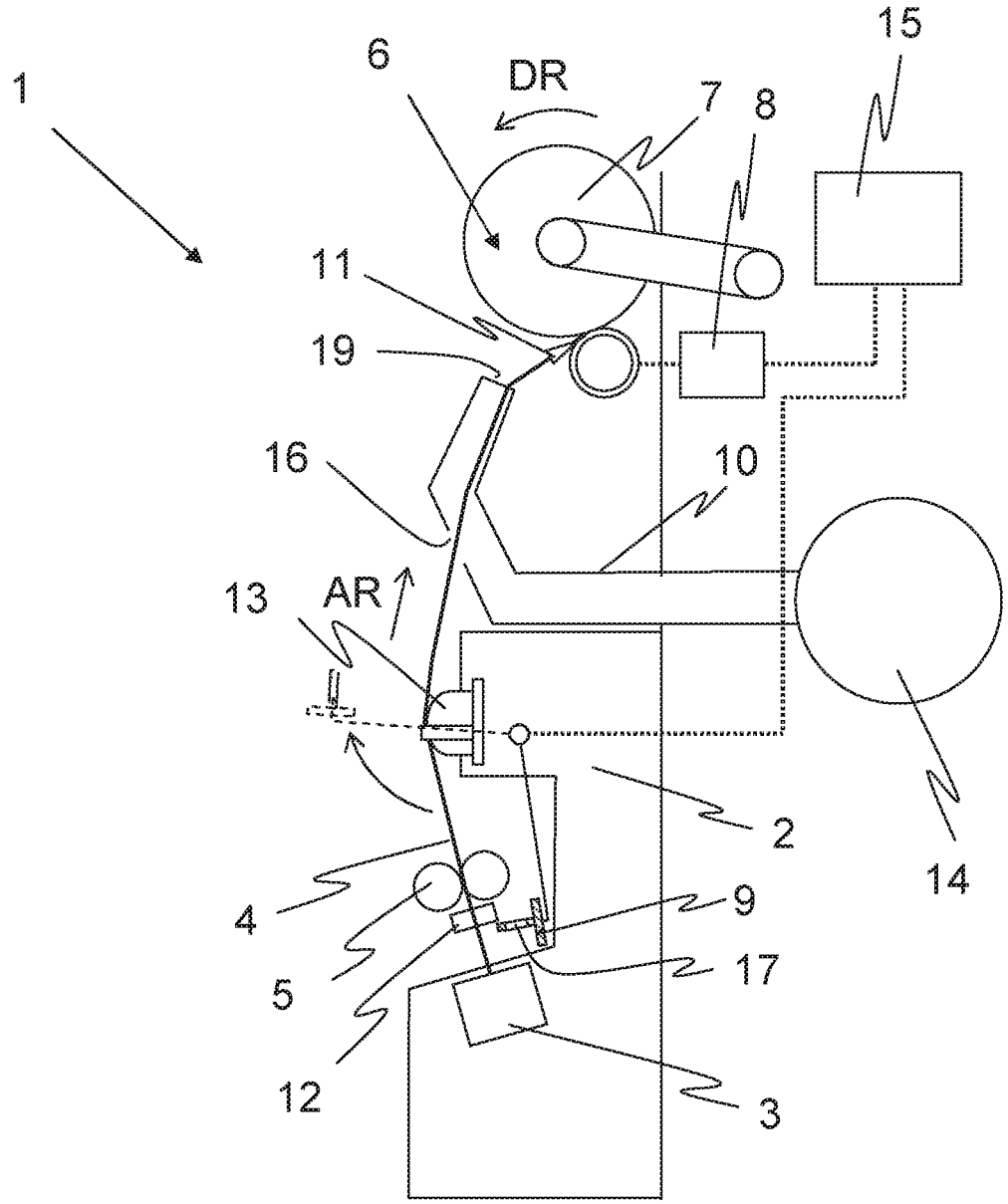
FIG. 1 shows a schematic sectional representation of a workstation of a textile machine during the regular operation.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic sectional representation of a workstation 2 of a textile machine 1. The workstation 2 includes a spinning device 3 in the usual way, with the aid of which a thread 4 is produced. The thread 4 is drawn out of the spinning device 3 with the aid of a draw-off device consisting of two delivery rollers 5 and is delivered to a winding device 6, where the thread 4 is wound onto a bobbin 7 with the aid of a thread guide 11. The winding device 6 includes, for this purpose, a drive 8, which drives the bobbin in its regular direction of rotation DR (see arrow) during the regular operation represented here. The direction of rotation DR as well as the regular draw-off direction AR of the thread 4 are indicated with the aid of arrows. Between the delivery rollers 5 and the winding device 6, the thread 4 can pass through even further units. For example, a waxing unit 13 is also provided in this case.

In deviation from the representation shown here, in which the textile machine 1 is designed as a spinning machine, it is also possible, of course, that the textile machine 1 is a winder. In this case, the workstation 2 does not comprise a spinning device 3, but rather only a delivery bobbin, from which the thread 4 is drawn and is then supplied to the winding device 6, as described.

Figure 2:
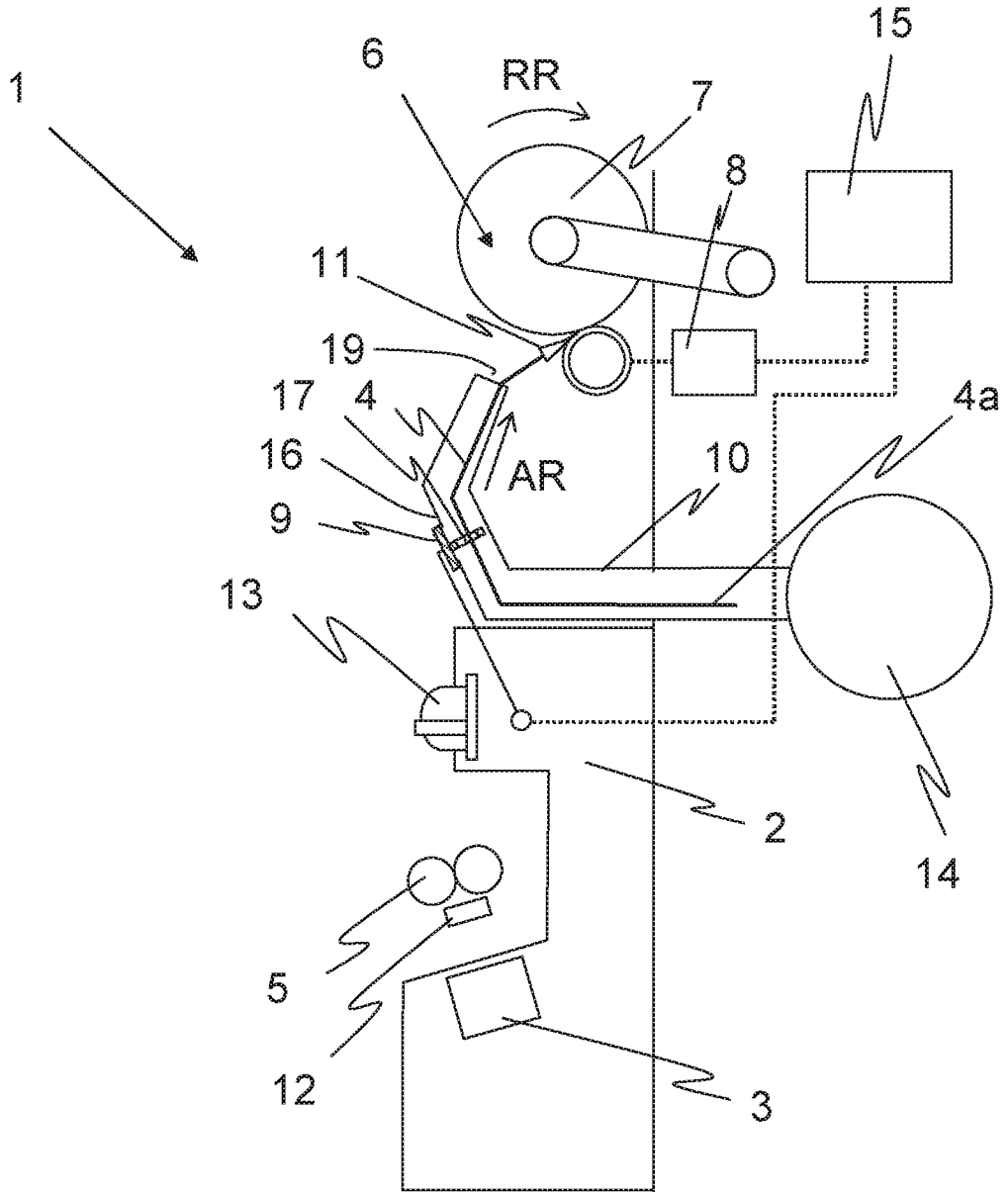
FIG. 2 shows the workstation after an interruption of the regular operation, wherein a thread has been sucked into a suction nozzle.
Figure 3:
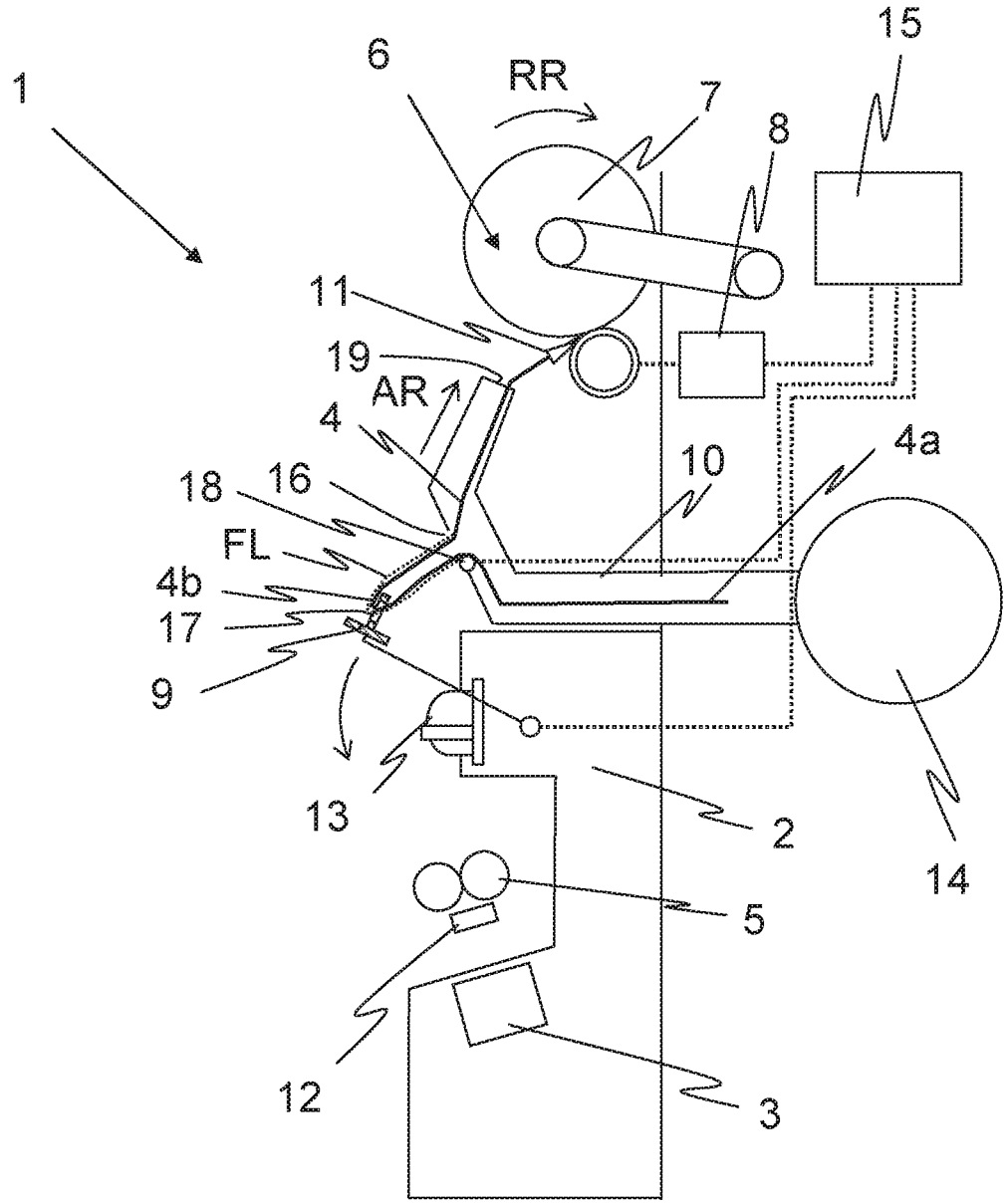
FIG. 3 shows the workstation of the textile machine in a further situation, in which a thread loop is being formed.
Figure 4:
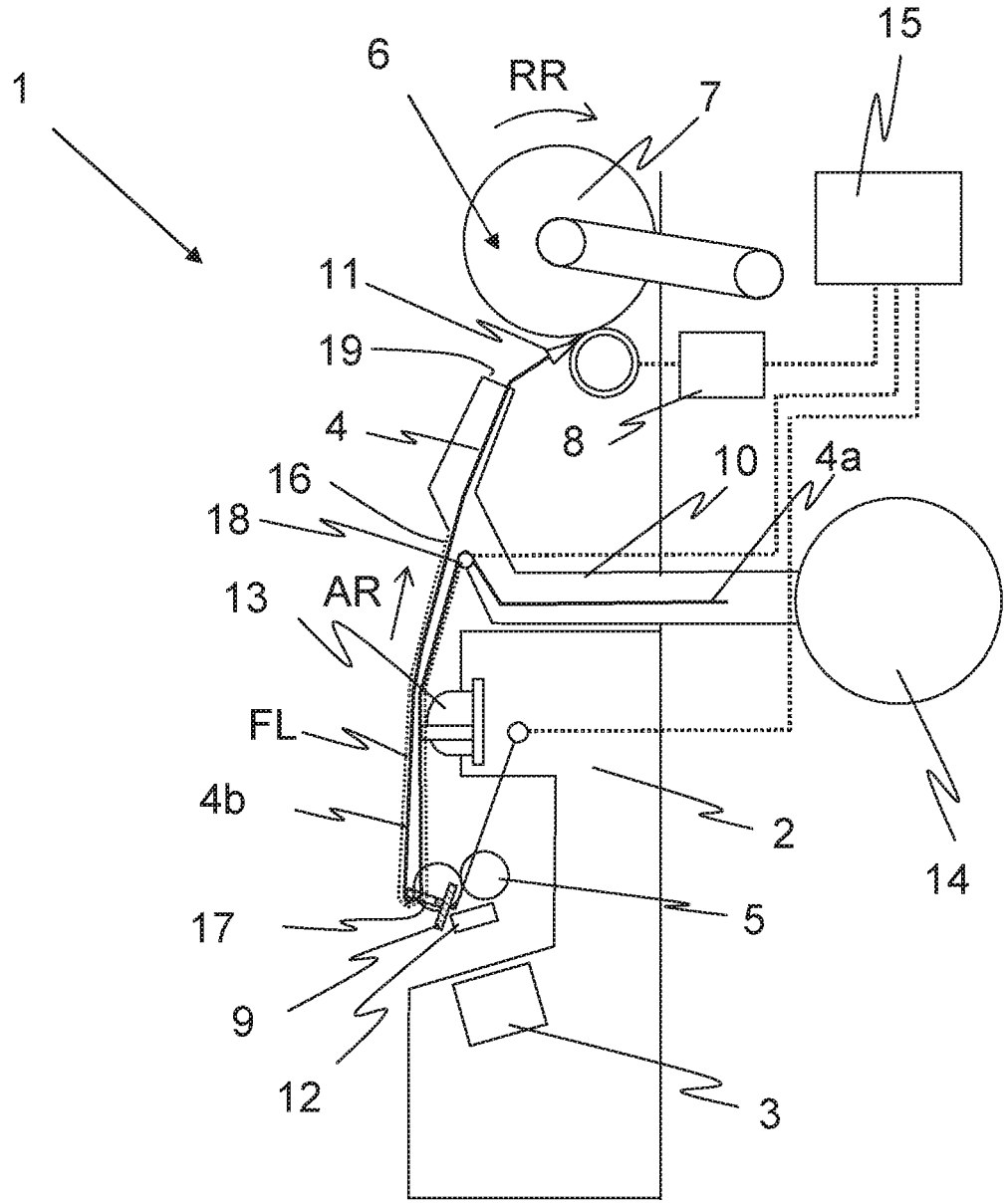
FIG. 4 shows the workstation of the textile machine in a situation, in which the formation of the thread loop has just been ended and the thread is being moved toward a piecing operation.

Moreover, the workstation 2 of the textile machine 1 shown here is designed as a so-called autonomous workstation 2 and includes a workstation-specific piecing unit 12, a workstation-specific suction nozzle 10, and a workstation-specific feeder unit 9, with the aid of which, after an interruption of production, the thread 4 can be accommodated by the suction nozzle 10 and presented to the workstation-specific piecing unit 12 in the form of a thread loop 4*b* (see FIGS. 3 and 4). The suction nozzle 10 is connected to a vacuum duct 14 in the usual way in this case and can be acted upon with vacuum via the vacuum duct 14 in order seek a thread end 4*a* on the surface of the bobbin 7 (see FIG. 2), which is run onto the bobbin 7, after an interruption of the spinning process or production.

According to the present representation, the suction nozzle 10 is situated at the workstation 2 in a stationary manner. During production, the thread 4 therefore passes through the suction nozzle 10, which the thread 4 enters at an opening 16 and which the thread 4 exits once again through the opening 19. Alternatively, it would also be conceivable, however, to allow the thread to extend outside the suction nozzle 10 in the known way and to then movably situate the suction nozzle 10 at the workstation 2 in order to be able to move the suction nozzle 10 toward the bobbin 7 in order to seek the thread end 4*a*.

The feeder unit 9 is provided for accommodating the thread 4 with the aid of a thread holder 17 and is pivotably situated at the workstation 2, as indicated by the arrow and the position of the feeder unit 9 indicated with the aid of a dashed line. Finally, the textile machine 1 also comprises a controller 15, with the aid of which at least the drive 8 and the feeder unit 9 can be controlled. The controller 15 can be provided, in this case, as a workstation-specific controller 15 as well as a central controller 15 of the textile machine 1. It is also possible that the controller 15 is provided as a group controller for multiple workstations 2.

Now that the textile machine 1 and the workstation 2 of the textile machine 1, including their units, have been described, the further method for piecing and forming a thread loop 4*b* will be explained with reference to FIGS. 2 to 4. The same reference characters will be utilized, in this case, for features which are identical or at least comparable to the exemplary embodiment represented in FIG. 1. Provided these features are not explained in detail once again, their design and mode of operation correspond to the design and mode of operation of the features already described above.

FIG. 2 shows the workstation 2 of the textile machine 1 in a situation in which production has been interrupted and an end 4*a* of the thread 4 is run onto the bobbin 7. The thread end 4*a* has therefore to be sought on the surface of the bobbin 7, for the purpose of which a vacuum is applied to the suction nozzle 10 and the bobbin 7 is driven by the drive 8 in the direction of reverse rotation RR (see arrow above the bobbin 7). The feeder unit 9 has already been pivoted out of its resting position or piecing position, which is shown in FIG. 1, into its thread receiving position which is represented in FIG. 2. The feeder unit 9 therefore extends, via its thread holder 17, into the cross-section of the suction nozzle 10, and so the thread 4 is not only sucked into the suction nozzle 10, it also simultaneously enters the thread holder 17 of the feeder unit 9. In the representation shown in FIG. 2, the thread therefore extends from the bobbin 7, via the opening 19 of the suction nozzle 10, through the thread holder 17 of the feeder unit 9 and is held by the suction force, which prevails within the suction nozzle 10. The thread end 4*a* has already been sucked into the suction nozzle 10 in this case.

FIG. 3 shows the workstation 2 of the textile machine 1 in one further situation, in which the formation of the thread loop 4*b* from the sucked-in end 4*a* of the thread 4 has already started. For this purpose, the feeder unit 9 with the thread 4 accommodated in the thread holder 17 is pivoted from the thread receiving position shown in FIG. 2 back in the direction of the piecing position, as indicated by the arrow. As is clear from the representation, an additional thread length FL, which is indicated in this case with the aid of a dotted line, is required in order to form the thread loop 4*b*. In contrast to the related art, the additional thread length FL is not drawn from the suction nozzle 10 once again. Instead, the additional thread length FL is made available from the winding device 6. For this purpose, the bobbin 7 is driven by the drive 8 in the direction of reverse rotation RR (see arrow above the bobbin 7). As compared to the related art, only a shorter length of the thread end 4*a* has to be drawn into the suction nozzle 10, which is just sufficient for holding the thread end 4*a* with the aid of the vacuum prevailing in the suction nozzle 10.

In particular, however, due to the return of the thread length FL from the bobbin 7 required for forming the thread loop 4*b*, it is possible to provide the thread length FL required specifically in this moment at any point in time of the feed movement of the feeder unit 9. For this purpose, the reverse rotation speed of the bobbin 7 is coordinated with the movement of the feed unit 9 in such a way that the thread length returned from the bobbin 7 always behaves synchronously to the thread length FL required for forming the thread loop 4*b*. In other words, a surplus of thread length does not arise at any point in time, which would possibly twist and could interfere with the subsequent piecing process. In addition, due to the synchronous coordination of the delivered thread length with the presently required thread length FL, an increased thread tension also does not arise at any point in time, which could otherwise cause the thread end 4*a* prepared for piecing to spring back, or could result in a thread end 4*a* which is too short. The risk of further thread breaks can also be reduced as a result.

It can also be advantageous, however, to always return a slightly shorter thread length from the bobbin than is specifically required for forming the thread loop. As a result, a surplus of thread length does not arise, which could twist or result in so-called backloops, and the thread can always be held under tension during the rewinding. In this case, the thread tensile force should be greater than the adhesiveness of the thread on the bobbin. As a result, the thread can no longer become caught on the bobbin. Instead, the thread is always cleanly unwound and returned.

Finally, FIG. 4 shows yet another workstation 2 of the textile machine 1 in a further situation, in which the formation of the thread loop 4*b* is nearly complete and the thread loop 4*b* is delivered to the piecing unit 12 for piecing. For this purpose, the feeder unit 9 is brought back into the piecing position, which is also shown in FIG. 1. Moreover, FIG. 4 shows, once again, the thread length FL, which has accumulated up to this point in time and is required for forming the thread loop 4*b*.

The thread loop 4*b* is then severed in a known way by the piecing unit 12, and so a new thread end 4*a* arises, which is prepared to be pieced again or to be pieced and is returned into the spinning device 3, where it is pieced once again. Provided the textile machine 1 is designed as a winder, the newly arisen thread end 4*a* is therefore moved toward a splicing device, where it is connected once again to a further thread end 4*a* which comes from the delivery bobbin. The original thread end 4*a*, which has now been separated, is then disposed of via the suction nozzle 10 and the vacuum duct 14.

In order to coordinate the reverse rotation speed of the bobbin 7 with the feed movement of the feeder unit 9, it is possible, for example, to specify a speed profile for the drive 8, which the drive 8 follows during the feed movement of the feeder unit 9. As a result, acceleration and braking times as well as a movement of the feeder unit 9, which is non-uniform with respect to the thread length FL can be taken into account and appropriately compensated for and, therefore, the thread tensile force can be held largely constant.

A particularly precise coordination and a delivery of the thread length returned from the bobbin 7 synchronously to the thread length FL required for forming the thread loop 4*b* are possible, however, when the thread tensile force in the sucked-in thread 4 is measured and the reverse rotation speed of the drive 8 is regulated in such a way that the thread tensile force is largely constant. For this purpose, a measuring unit 18 is provided at the workstation 2, specifically at the suction nozzle 10 in this case (see FIGS. 3 and 4), over which the thread 4 is guided during the formation of the thread loop 4*b*, and so the tensile force can be measured. The measuring unit 18 is also connected in a signal-transmitting manner to the controller 15 in order to control and regulate the reverse rotation speed of the bobbin 7. The measurement of the thread tensile force can be provided in addition to the control of the drive 8 according to a speed profile in order to improve the accuracy of the coordination of the reverse rotation speed with the feed movement of the feeder unit 9. It is also possible, however, to regulate the reverse rotation speed of the drive 8 only according to the thread tensile force of the thread 4.

The present invention is not limited to the represented and described exemplary embodiments. The method was described, in this case, with respect to a textile machine 1, which comprises autonomously designed workstations 2 including at least one workstation-specific drive 8 and one workstation-specific feed unit 9. The described method can be utilized particularly advantageously on such a textile machine 1. It is also possible, however, that the drive 8 and the feeder unit 9 are situated on a displaceable maintenance unit of the textile machine 1.

Further modifications and combinations within the scope of the patent claims are also possible, as is a combination of the features, even if they are represented and described in different exemplary embodiments.

LIST OF REFERENCE CHARACTERS

1 textile machine
2 workstation
3 spinning device
4 thread
4*a* end of the thread
4*b* thread loop
5 delivery roller
6 winding device
7 bobbin
8 drive of the bobbin
9 feeder unit
10 suction nozzle
11 thread guide
12 piecing unit
13 waxing unit
14 vacuum duct
15 controller
16 opening of the suction nozzle
17 thread holder
18 measuring unit
19 opening
AR draw-off direction
DR regular direction of rotation
RR direction of reverse rotation
FL required thread length for forming the thread loop

The invention claimed is:

1. A method for automatically piecing a thread at a workstation of a textile machine, comprising:

seeking an end of the thread on a surface of a bobbin with a suction nozzle;

unwinding the thread from the bobbin counter to a regular draw-off direction of the thread and sucking the thread into the suction nozzle;

driving the bobbin in a direction of reverse rotation with a drive for the unwinding of the thread;

draw-opening a thread loop in the thread and moving the thread loop towards a piecing unit via movement of a feeder unit;

driving the bobbin in the direction of reverse rotation during the drawing-open of the thread loop such that the thread is unwound from the bobbin;

coordinating a speed of the reverse rotation of the bobbin with movement of the feeder unit; and wherein the reverse rotation speed of the bobbin is coordinated such that at all time during the reverse rotation of the bobbin, a thread length withdrawn from the bobbin is less than a thread length required for forming the thread loop.

2. The method as in claim 1, wherein the reverse rotation speed of the bobbin is coordinated such that a thread length withdrawn from the bobbin is made available synchronously to the thread length required for forming the thread loop.

3. A method for automatically piecing a thread at a workstation of a textile machine, comprising:

seeking an end of the thread on a surface of a bobbin with a suction nozzle;

unwinding the thread from the bobbin counter to a regular draw-off direction of the thread and sucking the thread into the suction nozzle;

driving the bobbin in a direction of reverse rotation with a drive for the unwinding of the thread;

draw-opening a thread loop in the thread and moving the thread loop towards a piecing unit via movement of a feeder unit;

driving the bobbin in the direction of reverse rotation during the drawing-open of the thread loop such that the thread is unwound from the bobbin; and coordinating a speed of the reverse rotation of the bobbin with movement of the feeder unit; and wherein the reverse rotation speed of the bobbin is coordinated such that at all time during the reverse rotation of the bobbin, a thread length withdrawn from the bobbin is greater than a thread length required for forming the thread loop.

4. The method as in claim 1, wherein the drive is driven according to a speed profile during movement of the feeder unit.

5. The method as in claim 1, further comprising measuring a tensile force of the thread during movement of the feeder unit and controlling the drive according to the measured tensile force.

6. A textile machine comprising a workstation, the workstation further comprising:

a suction nozzle for seeking an end of a thread on a surface of a bobbin and sucking in the thread;

a drive configured to drive the bobbin such that the thread is withdrawn from the bobbin counter to a regular draw-off direction of the thread;

a piecing unit;

a feeder unit configured to drawn-open a thread loop in the thread withdrawn from the bobbin and move the thread loop towards the piecing unit, the feeder unit pivotably arranged at the workstation to account for a varying speed of the yarn transported by the feeder unit during movement of the feeder unit;

a controller configured for operating the drive in a direction of reverse rotation during the draw-opening of the thread loop such that the thread is unwound from the bobbin and a speed of the reverse rotation of the bobbin is tied with movement of the feeder unit; and wherein the reverse rotation speed of the bobbin is controlled such that at all time during the reverse rotation of the bobbin, a thread length withdrawn from the bobbin is less than a thread length required for forming the thread loop.

7. The textile machine as in claim 6, wherein the drive and the feeder unit are situated at the workstation.

8. The textile machine as in claim 6, wherein the feeder unit moves in a pivoting motion.

9. The textile machine as in claim 6, further comprising a measuring unit disposed to measure a tensile force of the thread sucked into the nozzle.

10. A method for automatically piecing a thread at a workstation of a textile machine, comprising:

seeking an end of the thread on a surface of a bobbin with a suction nozzle;

unwinding the thread from the bobbin counter to a regular draw-off direction of the thread and sucking the thread into the suction nozzle;

driving the bobbin in a direction of reverse rotation with a drive for the unwinding of the thread;

draw-opening a thread loop in the thread and moving the thread loop towards a piecing unit via movement of a feeder unit;

driving the bobbin in the direction of reverse rotation during the drawing-open of the thread loop such that the thread is unwound from the bobbin; and coordinating a speed of the reverse rotation of the bobbin with movement of the feeder unit; and wherein the drive is driven according to a speed profile during movement of the feeder unit.

* * * * *